US007970483B2

(12) United States Patent
Raoux et al.

(10) Patent No.: US 7,970,483 B2
(45) Date of Patent: Jun. 28, 2011

(54) METHODS AND APPARATUS FOR IMPROVING OPERATION OF AN ELECTRONIC DEVICE MANUFACTURING SYSTEM

(75) Inventors: Sebastien Raoux, Santa Clara, CA (US); Mark W. Curry, Morgan Hill, CA (US); Peter Porshnev, San Jose, CA (US); Allen Fox, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/685,993

(22) Filed: Mar. 14, 2007

(65) Prior Publication Data

US 2007/0260343 A1 Nov. 8, 2007

Related U.S. Application Data

(60) Provisional application No. 60/783,370, filed on Mar. 16, 2006, provisional application No. 60/890,609, filed on Feb. 19, 2007, provisional application No. 60/783,374, filed on Mar. 16, 2006, provisional application No. 60/783,337, filed on Mar. 16, 2006.

(51) Int. Cl.
*G05B 13/04* (2006.01)
*G06F 19/00* (2011.01)

(52) U.S. Cl. ..... 700/108; 700/30; 700/32

(58) Field of Classification Search ..... 700/28–32, 700/108–110, 117–121
See application file for complete search history.

(56) References Cited

U.S. PATENT DOCUMENTS

| | | | | |
|---|---|---|---|---|
| 3,918,915 | A | 11/1975 | Holler, Jr. | |
| 4,280,184 | A | 7/1981 | Weiner et al. | |
| 4,701,187 | A | 10/1987 | Choe et al. | |
| 4,720,807 | A | 1/1988 | Ferran et al. | |
| 4,820,319 | A | 4/1989 | Griffis | |
| 5,001,420 | A | 3/1991 | Germer et al. | |
| 5,004,483 | A | 4/1991 | Eller et al. | |
| 5,264,708 | A | 11/1993 | Hijikata | |
| 5,682,317 | A * | 10/1997 | Keeler et al. | 701/101 |
| 5,759,237 | A | 6/1998 | Li et al. | |
| 5,910,294 | A | 6/1999 | Langan et al. | |
| 5,976,222 | A | 11/1999 | Yang et al. | |
| 6,195,621 | B1 | 2/2001 | Bottomfield | |
| 6,277,347 | B1 | 8/2001 | Stearns et al. | |
| 6,316,045 | B1 | 11/2001 | Bernard et al. | |
| 6,419,455 | B1 * | 7/2002 | Rousseau et al. | 417/36 |

(Continued)

FOREIGN PATENT DOCUMENTS

WO WO 2005/121912 A1 12/2005

(Continued)

OTHER PUBLICATIONS

Mooney et al., "Pump Predictive Diagnostics (online)", Solid State Technology, Jul. 2005, pp. 1-3.

(Continued)

*Primary Examiner* — M. N. Von Buhr
(74) *Attorney, Agent, or Firm* — Dugan & Dugan, P.C.

(57) ABSTRACT

In one aspect of the invention, a method for the improved operation of an electronic device manufacturing system is provided. The method includes providing information to an interface coupled to an electronic device manufacturing system having parameters, processing the information to predict a first parameter, and providing an instruction related to at least a second parameter of the electronic device manufacturing system wherein the instruction is based on the predicted first parameter. Numerous other aspects are provided.

16 Claims, 8 Drawing Sheets

U.S. PATENT DOCUMENTS

| | | | | |
|---|---|---|---|---|
| 6,468,490 | B1 | 10/2002 | Shamouilian et al. | |
| 6,500,487 | B1 | 12/2002 | Holst et al. | |
| 6,617,175 | B1 | 9/2003 | Arno | |
| 6,694,286 | B2 * | 2/2004 | Ottosson | 702/182 |
| 6,725,098 | B2 * | 4/2004 | Edwards et al. | 700/31 |
| 6,748,280 | B1 * | 6/2004 | Zou et al. | 700/31 |
| 6,760,716 | B1 * | 7/2004 | Ganesamoorthi et al. | 706/21 |
| 6,772,036 | B2 * | 8/2004 | Eryurek et al. | 700/127 |
| 6,809,837 | B1 * | 10/2004 | Mestha et al. | 358/1.9 |
| 6,905,663 | B1 | 6/2005 | Arno | |
| 6,925,373 | B2 * | 8/2005 | La Rosa et al. | 701/109 |
| 6,988,017 | B2 * | 1/2006 | Pasadyn et al. | 700/121 |
| 7,020,546 | B2 * | 3/2006 | Nagai et al. | 701/29 |
| 7,079,904 | B1 * | 7/2006 | Forstrom et al. | 700/28 |
| 7,127,304 | B1 * | 10/2006 | Gould et al. | 700/20 |
| 7,231,291 | B2 * | 6/2007 | Dollmeyer et al. | 701/114 |
| 7,349,746 | B2 * | 3/2008 | Emigholz et al. | 700/21 |
| 7,359,842 | B1 * | 4/2008 | Tsutsui et al. | 703/2 |
| 7,421,348 | B2 * | 9/2008 | Swanson | 702/32 |
| 7,463,937 | B2 * | 12/2008 | Korchinski | 700/31 |
| 7,474,989 | B1 * | 1/2009 | Wilcoxon | 702/185 |
| 7,499,777 | B2 * | 3/2009 | Grichnik et al. | 701/29 |
| 7,499,842 | B2 * | 3/2009 | Grichnik et al. | 703/2 |
| 7,505,949 | B2 * | 3/2009 | Grichnik | 706/44 |
| 7,624,079 | B2 * | 11/2009 | Hartman et al. | 706/16 |
| 2002/0116079 | A1 * | 8/2002 | Kern et al. | 700/32 |
| 2003/0097197 | A1 * | 5/2003 | Parent et al. | 700/108 |
| 2003/0154044 | A1 * | 8/2003 | Lundstedt et al. | 702/104 |
| 2003/0194367 | A1 | 10/2003 | Dunwoody et al. | |
| 2004/0001787 | A1 | 1/2004 | Porshnev et al. | |
| 2004/0074846 | A1 | 4/2004 | Stever et al. | |
| 2004/0144421 | A1 | 7/2004 | Parce et al. | |
| 2004/0168108 | A1 * | 8/2004 | Chan et al. | 714/47 |
| 2004/0176860 | A1 * | 9/2004 | Hovakimyan et al. | 700/29 |
| 2004/0213721 | A1 | 10/2004 | Arno et al. | |
| 2004/0255848 | A1 | 12/2004 | Yudasaka | |
| 2005/0087298 | A1 * | 4/2005 | Tanaka et al. | 156/345.24 |
| 2005/0109207 | A1 | 5/2005 | Olander et al. | |
| 2005/0147509 | A1 | 7/2005 | Bailey et al. | |
| 2005/0160983 | A1 | 7/2005 | Sneh | |
| 2005/0163622 | A1 | 7/2005 | Yamamoto et al. | |
| 2005/0177273 | A1 | 8/2005 | Miyazaki et al. | |
| 2005/0207961 | A1 | 9/2005 | Brooks et al. | |
| 2005/0209827 | A1 * | 9/2005 | Kitchin | 702/189 |
| 2005/0233092 | A1 | 10/2005 | Choi et al. | |
| 2005/0252884 | A1 | 11/2005 | Lam et al. | |
| 2005/0256593 | A1 * | 11/2005 | Ogunnaike et al. | 700/44 |
| 2005/0283321 | A1 | 12/2005 | Yue et al. | |
| 2006/0031048 | A1 * | 2/2006 | Gilpin et al. | 703/6 |
| 2006/0104878 | A1 | 5/2006 | Chiu et al. | |
| 2006/0104879 | A1 | 5/2006 | Chiu | |
| 2006/0111575 | A1 | 5/2006 | DeCourcy et al. | |
| 2006/0116531 | A1 | 6/2006 | Wonders et al. | |
| 2006/0173559 | A1 * | 8/2006 | Kirshenbaum et al. | 700/31 |
| 2006/0175012 | A1 | 8/2006 | Lee | |
| 2006/0259198 | A1 * | 11/2006 | Brcka et al. | 700/246 |
| 2007/0012402 | A1 | 1/2007 | Sneh | |
| 2007/0060738 | A1 | 3/2007 | DeBruin | |
| 2007/0079758 | A1 | 4/2007 | Holland et al. | |
| 2007/0086931 | A1 | 4/2007 | Raoux et al. | |
| 2007/0135939 | A1 * | 6/2007 | Johnson et al. | 700/31 |
| 2007/0166205 | A1 | 7/2007 | Holst et al. | |
| 2007/0172398 | A1 | 7/2007 | Clark | |
| 2007/0256704 | A1 | 11/2007 | Porshnev et al. | |
| 2007/0260351 | A1 | 11/2007 | Curry | |
| 2008/0003158 | A1 | 1/2008 | Raoux et al. | |
| 2008/0072822 | A1 | 3/2008 | White | |
| 2008/0087217 | A1 | 4/2008 | Yudasaka | |
| 2008/0133550 | A1 * | 6/2008 | Orangi et al. | 707/100 |
| 2008/0290041 | A1 | 11/2008 | Clark | |
| 2008/0300709 | A1 * | 12/2008 | Collette et al. | 700/103 |
| 2008/0310975 | A1 | 12/2008 | Chandler | |
| 2009/0017206 | A1 | 1/2009 | Clark | |
| 2009/0018688 | A1 | 1/2009 | Chandler | |

FOREIGN PATENT DOCUMENTS

| | | | |
|---|---|---|---|
| WO | WO 2007/109082 | A2 | 9/2007 |
| WO | WO 2007/109038 | A2 | 9/2008 |
| WO | WO 2007/109081 | A2 | 9/2008 |
| WO | WO 2008/147522 | A1 | 12/2008 |
| WO | WO 2008/147523 | A1 | 12/2008 |
| WO | WO 2008/147524 | A1 | 12/2008 |
| WO | WO 2008/156687 | A1 | 12/2008 |

OTHER PUBLICATIONS

"Conductance Calculations", Dec. 27, 2005, Kurt J. Lesker Company, pp. 1-3.

"Vacuum System Overview: Pressure, Mass-flow and Conductance", Mar. 15, 2004, pp. 1-10.

International Search Report and Written Opinion of International Application No. PCT/US07/06495 mailed Jul. 15, 2008.

Office Action of U.S. Appl. No. 11/686,012, mailed Nov. 16, 2007.

Final Office Action of U.S. Appl. No. 11/686,012, mailed May 21, 2008.

International Search Report and Written Opinion of International Application No. PCT/US07/06392 mailed Mar. 27, 2008.

Office Action of U.S. Appl. No. 11/686,005, mailed Jul. 31, 2008.

International Search Report and Written Opinion of International Application No. PCT/US07/06494 mailed Jun. 4, 2008.

U.S. Appl. No. 12/258,395, filed Oct. 25, 2008.

U.S. Appl. No. 12/348,012, filed Jan. 1, 2009.

Fireye CU-20 "Documentation for 45UV5 and 25SU3", May 1994.

U.S. Appl. No. 12/257,888, filed Oct. 24, 2008.

International Preliminary Report on Patentability of International Application No. PCT/US2007/006495 dated Oct. 23, 2008.

* cited by examiner

| | C1 | μ1 | σ1 | C2 | μ2 | σ2 | C3 | μ3 | σ3 | C4 | μ4 | σ4 |
|---|---|---|---|---|---|---|---|---|---|---|---|---|
| NF3 | 11 | 14 | 6.0 | 17 | 36 | 19 | 3.0 | 65 | 9.1 | 10 | 91 | 11 |
| C2F6 | 11 | 18 | 7.0 | 29 | 36 | 17 | 12 | 67 | 11 | 12 | 88 | 9.0 |
| COF2 | 13 | 22 | 9.0 | 39 | 46 | 17 | 2.9 | 65 | 9.1 | 23 | 79 | 11 |
| CF4 | 9.4 | 17 | 7.1 | 34 | 36 | 15 | 3.0 | 53 | 5.4 | 14 | 66 | 9.0 |
| SiF4 | 7.3 | 20 | 6.6 | 42 | 40 | 14 | 2.1 | 54 | 5.3 | 27 | 70 | 10 |

METHODS AND APPARATUS FOR IMPROVING OPERATION OF AN ELECTRONIC DEVICE MANUFACTURING SYSTEM

The present application claims priority to U.S. Provisional Patent Application Ser. No. 60/783,370, filed Mar. 16, 2006 and entitled "METHODS AND APPARATUS FOR IMPROVING OPERATION OF AN ELECTRONIC DEVICE MANUFACTURING SYSTEM", US Provisional Application Ser. No. 60/890,609, filed Feb. 19, 2007 and entitled "METHODS AND APPARATUS FOR A HYBRID LIFE CYCLE INVENTORY FOR ELECTRONIC DEVICE MANUFACTURING", U.S. Provisional Application Ser. No. 60/783,374, filed Mar. 16, 2006 and entitled "METHODS AND APPARATUS FOR PRESSURE CONTROL IN ELECTRONIC DEVICE MANUFACTURING SYSTEMS", and U.S. Provisional Application Ser. No. 60/783,337, filed Mar. 16, 2006 and entitled "METHOD AND APPARATUS FOR IMPROVED OPERATION OF AN ABATEMENT SYSTEM", all of which are hereby incorporated herein by reference in their entirety for all purposes.

CROSS REFERENCE TO RELATED APPLICATIONS

The present application is related to the following commonly-assigned, co-pending U.S. Patent Applications, each of which is hereby incorporated herein by reference in its entirety for all purposes:

U.S. patent application Ser. No. 11/686,012, filed Mar. 14, 2007, and issued May 12, 2009 as U.S. Pat. No. 7,532,952, and titled "IMPROVED METHODS AND APPARATUS FOR PRESSURE CONTROL IN ELECTRONIC DEVICE MANUFACTURING SYSTEMS"; and U.S. patent application Ser. No. 11/686,005, filed Mar. 14, 2007, and titled "METHOD AND APPARATUS FOR IMPROVED OPERATION OF AN ABATEMENT SYSTEM".

FIELD OF THE INVENTION

The present invention relates generally to electronic device manufacturing and more particularly to apparatus and methods for optimal operation of an electronic device manufacturing system.

BACKGROUND OF THE INVENTION

Electronic device manufacturing tools conventionally employ chambers or other suitable apparatus adapted to perform processes (e.g., chemical vapor deposition, epitaxial silicon growth, etch, etc.) to manufacture electronic devices. Such processes may produce effluents having undesirable chemicals as by-products of the processes. Conventional electronic device manufacturing systems may use abatement apparatus to treat the effluents.

Conventional abatement units and processes employ a variety of resources (e.g., reagents, water, electricity, etc.) to treat the effluents. Such abatement units typically operate with little information about the effluents being treated by the abatement units. Accordingly, conventional abatement units may sub-optimally use the resources. Sub-optimal use of the resources may be an undesirable cost burden in a production facility. In addition, more frequent maintenance may be required for abatement units that do not use resources optimally.

Accordingly, a need exists for improved methods and apparatus for abating effluents.

SUMMARY OF THE INVENTION

In a first aspect of the invention, a first method for improving operation of an electronic device manufacturing system is provided. The first method includes providing information to an interface coupled to an electronic device manufacturing system having parameters, processing the information to predict a first parameter, and providing an instruction related to at least a second parameter of the electronic device manufacturing system wherein the instruction is based on the predicted first parameter.

In a second aspect of the invention, a second method for improving operation of an electronic device manufacturing system is provided. The second method includes measuring production parameters from a production electronic device manufacturing system, comparing the production parameters with a database associated with a reference system using a program, and predicting at least one parameter of the production electronic device manufacturing system.

In a third aspect of the invention, a third method for improving operation of an electronic device manufacturing system is provided. The third method includes creating a database and program based on measurements from a reference electronic device manufacturing system, employing the database and program in a production electronic device manufacturing system to create a predictive solution for the production electronic device manufacturing system, and operating the production electronic device manufacturing system in accordance with the predictive solution.

Other features and aspects of the present invention will become more fully apparent from the following detailed description, the appended claims and the accompanying drawings.

DETAILED DESCRIPTION

The present invention provides methods and apparatus for improved (e.g., optimized) operation of a production electronic device manufacturing system. More specifically, the present methods and apparatus employ an interface between the components of a production electronic device manufacturing system, a reference database and one or more programs. The programs may be used to predict maintenance of components in the system, and consequently, may increase system availability by reducing system downtime. Additionally or alternatively, the one or more programs and database may be used to accurately predict the quantity and types of effluents flowing to an abatement unit for treating effluents of the electronic device manufacturing system based on such data, and thereby allow the interface to more optimally operate the abatement unit based on the prediction.

The reference database and programs may use information provided by a reference electronic device manufacturing system. The reference system may have a configuration of components, units, and parameters similar to numerous production systems. Sophisticated instruments may be coupled to the reference system to acquire information about the effluent and parameters of the reference system. The instruments may be prohibitively expensive to use on a large number of production electronic device manufacturing systems.

In accordance with one or more aspects of the present invention, the information acquired by the instruments may be employed to form a predictive solution. The predictive solution may be employed to optimally operate production systems without requiring the use and undesirable costs associated with the instruments used by the reference system. The predictive solution may include a database of the reference system and one or more programs. In at least one embodiment, the predictive solution may be provided to the customer for a fee via a number of methods and media.

Figure 1:
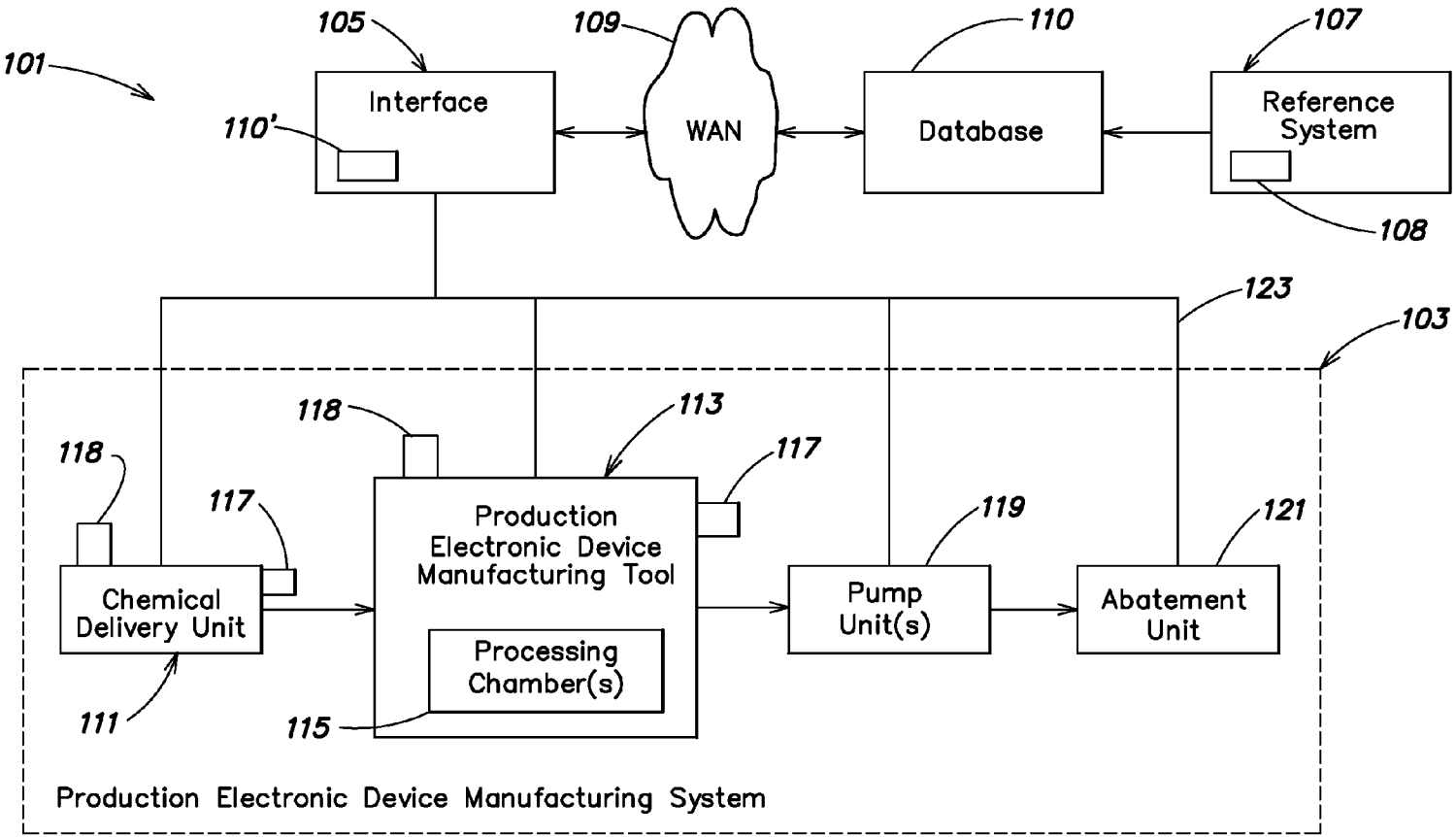
FIG. 1 is a block diagram of a system for improving electronic device manufacturing in accordance with the present invention.

FIG. 1 is a block diagram of a system for improving electronic device manufacturing in accordance with the present invention. With reference to FIG. 1, the system 101 for improving electronic device manufacturing includes a production electronic device manufacturing system 103 that is coupled to an interface 105 for receiving data, such as status and/or operational data, from the production electronic device manufacturing system 103. Based on the received data, the interface 105 may predict other status and/or operational data related to the production system 103. Details of the interface 105 are described below with reference to FIG. 2.

In some embodiments, the interface 105 may be coupled to a reference database 110, for example, via a wide area network (WAN) 109 or other suitable communications medium/network. Reference data may be collected with instruments 108 making precise measurements of the reference system 107. The instruments 108 may also include devices such as mass flow controllers, pressure gauges, etc. The instruments 108 may be omitted from the production system 103 due to the cost of such instruments 108 or for other reasons. For example, the reference system 107 may include instruments 108 adapted to perform methods of detecting and quantifying emissions upstream of an abatement unit of the reference system 107, such as Fourier Transform Infra Red (FTIR) Spectroscopy or Quadrupole Mass Spectroscopy (QMS). Based on such methods, the instruments may collect information (e.g., empirical data related to equipment status and/or operational data) related to the reference system 107. The information may also include information from the reference system 107 related to parameters such as gas flows, radio frequency (RF) power, etc. The information may be collected and/or analyzed. The information and/or analysis results may be stored in the reference database 110.

The measurements and/or analysis may be performed via a number of methods. For example, the measurements may be done offline in a non-production facility (e.g., research and development facility). Alternatively, the measurements may be performed in the same facility as the production system 103. The instruments 108 that perform the measurements may be operated/controlled remotely and/or locally. The instruments 108 may be adapted to analyze the information (e.g., creating histograms, curve fitting, etc.) so as to create objects (e.g., software routines, predictive functions, constants, etc.) that may be employed by the interface 105. Alternatively, analysis may be done on the information and/or objects offline on a workstation (e.g., processor based system) or other suitable apparatus adapted to analyze or manipulate the information. The information and/or objects may be communicated to the reference database 110 in any number of ways. For example, the information and/or objects may be communicated via a network such as a LAN or WAN, and/or via other media such as CD-R, floppies, etc.

In some embodiments, the interface 105 may access and/or retrieve the information and/or objects from the database 110 (e.g., via a WAN 109). The information and/or objects retrieved may be employed to form and/or populate a database 110' in the interface 105. Details of the database 110' are described below with reference to FIGS. 2 and 3. The interface 105 may also provide data (e.g., real time, stored, etc.) from the production system 103 and internal programs to retrieve parameters for the production system 103. Although a WAN 109 is depicted, information and/or objects may be loaded into the interface 105 via various mediums such as the WAN 109, CD-R, floppies, etc. In some embodiments, the interface 105 may be mechanically coupled to the production system 103. Alternatively, the interface 103 may be mechanical and/or electrically coupled to a device other than the production system 103 (e.g., an independent work station, a remotely accessed microcontroller, etc.).

The production system 103 may include units such as a chemical delivery unit 111 (e.g., gas panel, a slurry delivery unit, a liquid precursor delivery system, etc.). The chemical delivery unit 111 may be adapted to deliver chemicals to a production electronic device manufacturing tool 113. The production tool 113 may include one or more processing chambers 115 for performing one or more processes on a substrate. The electronic device manufacturing tool 113 is downstream from the chemical delivery unit 111. Sensors 117 and/or controllers 118 may be coupled to the chemical delivery unit 111 and/or the electronic device manufacturing tool 113 for detecting information during electronic device manufacturing. The sensors 117 and/or controllers 118 may provide information (e.g., status, operational, etc.) that may be employed by the interface 105. The information may be related to parameters such as the presence of a certain gas at the output of the chemical delivery unit 111 and/or production tool 113 (e.g., mass flow controllers). Other sensor types may be used such as a pressure gauge, timers for measuring step times, power meters, etc.

The information may be provided to the interface 105 by a controller 118 (e.g., rack-mounts, workstations, controller boards, embedded processors, etc.) adapted to control, and/or receive information from the production tool 113 and/or processing chambers 115. The controller 118 may be implemented as a plurality of controllers. For example, in other embodiments, the production tool 113 may be coupled to a first controller 118 and the processing chamber 115 may be coupled to a second controller 118. Alternatively, a single controller 118 and/or a network of controllers 118 may be employed to control the production tool 113 and/or processing chambers 115. The information provided by the controllers 118 may be related to control signals provided by the controller 118 to the portions of the production system 103. For example, the controller 118 may provide a signal to the processing chambers 115 to begin a step in a process recipe. Such information may be provided to the interface 105.

Downstream from the electronic device manufacturing tool 113, the production system 103 may include one or more pump units 119 coupled to the production tool 113. The pump units 119 may be adapted to reduce the pressure in portions of the production tool 113 (e.g., transfer chamber, load-locks, etc.) and/or processing chambers 115 (e.g., metal etch, CVD chamber, etc.). In other embodiments, additional apparatus such as vacuum pumps (e.g., turbo-molecular pumps, cryopumps, etc.) or any other suitable apparatus may further reduce the pressures in the processing chambers 115. The pressure in the processing chambers 115 may be controlled via a combination of parameters such as throttle valve position, turbo-molecular pump speed, gas flows into the processing chambers 115 and/or production electronic device manufacturing tool 113 in addition to parameters of the pump units 119. For example, the pressure in the processing chambers 115 may be controlled by the pump speed (e.g., revolutions per minute) of the pump units 119. The pump units 119 may operate during electronic device manufacturing. The pump units 119 may also operate when the processing chambers 115 do not have substrates with electronic devices present in the processing chambers 115. The pump units 119 may exhaust effluents (e.g., gases, fluids, solids, etc.) from the processing chambers 115.

Similarly, downstream from the pump units 119, the production system 103 may include an abatement unit 121 coupled to the pump units 119. The abatement unit 121 may treat effluents of the production tool 113. The abatement unit 121 may include a controlled decomposition oxidation (CDO) thermal reactor, water scrubber, absorption based passive resin, combustion system, etc. An exemplary abatement unit 121 is the Marathon system available from Metron Technology, Inc. of San Jose, Calif. Other abatement units may be used. The interface 105, the chemical delivery unit 111, the production tool 113, the pump units 119 and the abatement units 121 may be operatively coupled to allow communications among such components 105, 111, 113, 119, 121. For example, such components may be operatively coupled via a local area network (LAN) 123 or other communications network/medium.

Figure 2:
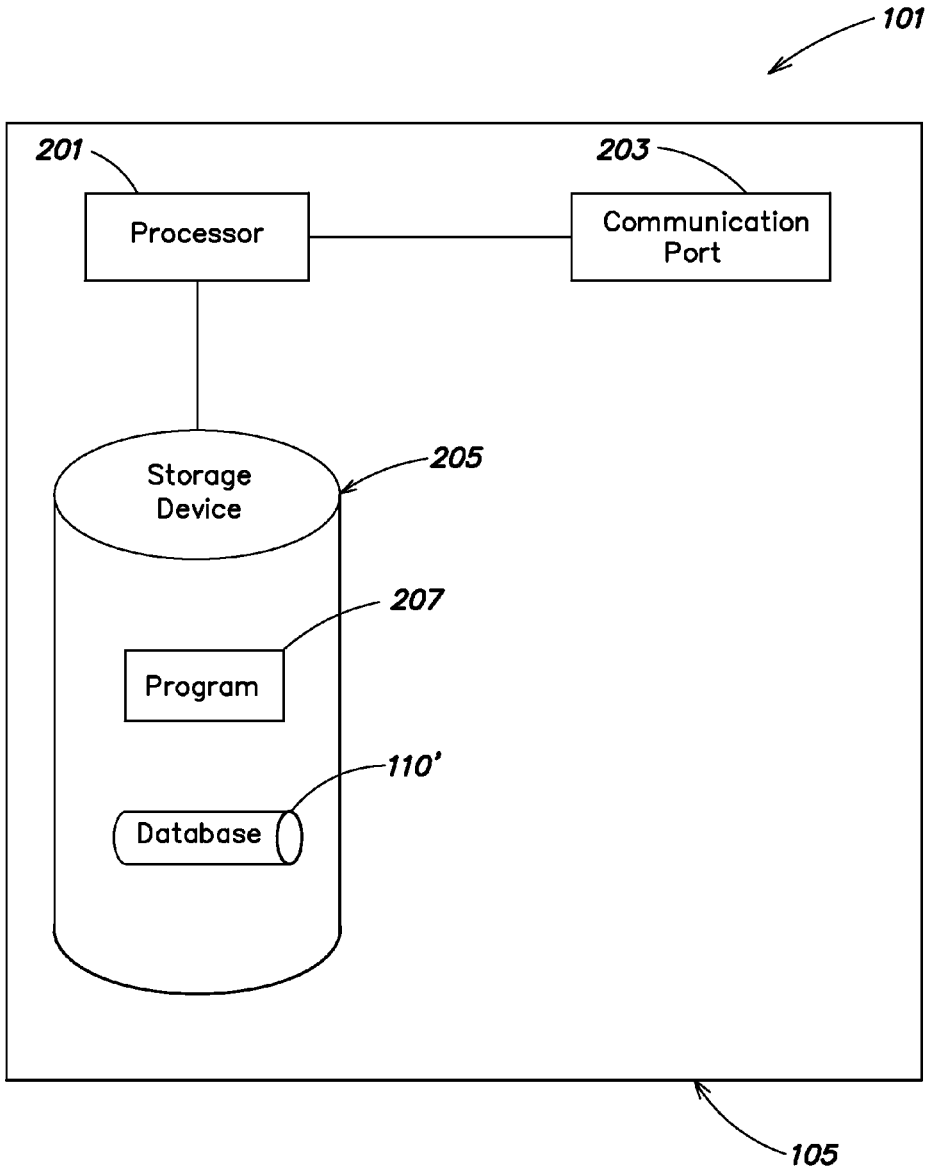
FIG. 2 is a block diagram of an interface of the system for improving electronic device manufacturing in accordance with the present invention.

FIG. 2 is a block diagram of an interface 105 of the system 101 for improving electronic device manufacturing in accordance with the present invention. With reference to FIG. 2, the interface 105 is operative to execute the methods of the present invention. As described below, the interface 105 may store a database and perform one or more programs for predicting status and/or operational data related to the production system 103. The interface 105 may be implemented as one or more system controllers, one or more dedicated hardware circuits, one or more appropriately programmed general purpose computers, or any other similar electronic, mechanical, electromechanical, and/or human operated device.

The interface 105 may include a processor 201, such as one or more Intel® Pentium® processors, for executing programs and one or more communication ports 203 through which the processor 201 communicates with other devices, such as the production system 103. The processor 201 is also in communication with a data storage device 205. The data storage device 205 may include any appropriate combination of magnetic, optical and/or semiconductor memory, and may include, for example, additional processors, communication ports, Random Access Memory ("RAM"), Read-Only Memory ("ROM"), a compact or digital-versatile disc and/or a hard disk. The processor 201 and the data storage device 205 may each be, for example: (i) located entirely within a single computer or other computing device; or (ii) connected to each other by a remote communication medium, such as a serial port cable, a LAN, a telephone line, a radio frequency transceiver, a fiber optic connection or the like. In some embodiments, for example, the interface 105 may comprise one or more computers (or processors 201) that are connected to a remote server computer, such as a computer included in the reference system 107, operative to maintain databases, where the data storage device 205 is comprised of the combination of the remote server computer and the associated databases.

The data storage device 205 may store a program 207 for controlling the processor 201. The processor 201 may perform instructions of the program 207, and thereby operate in accordance with the present invention, and particularly in accordance with the methods described in detail herein. The present invention may be embodied as a computer program developed using an object oriented language that allows the modeling of complex systems with modular objects to create abstractions that are representative of real world, physical objects and their interrelationships. However, it would be understood by one of ordinary skill in the art that the invention as described herein can be implemented in many different ways using a wide range of programming techniques as well as general purpose hardware systems or dedicated controllers. The program 207 may be stored in a compressed, uncompiled and/or encrypted format. The program 207, furthermore, may include program elements that may be generally useful, such as an operating system, a database management system and "device drivers" for allowing the processor 201 to interface with computer peripheral devices such as the communication ports 203. Appropriate general purpose program elements are known to those skilled in the art, and need not be described in detail herein.

Further, the program 207 may be operative to execute a number of invention-specific modules or subroutines including but not limited to one or more routines to allow the interface 105 to predict parameters (e.g., status, operational data, etc.) related to the production system 103. Examples of these parameters are described in detail below in conjunction with the flowcharts depicted in FIGS. 4 through 6.

According to some embodiments of the present invention, the instructions of the program 207 may be read into a main memory (not pictured) of the processor 201 from another computer-readable medium, such as from a ROM to a RAM. Execution of sequences of the instructions in the program 207 causes the processor 201 to perform the process steps described herein. In alternative embodiments, hard-wired circuitry or integrated circuits may be used in place of, or in combination with, software instructions for implementation of the processes of the present invention. Thus, embodiments of the present invention are not limited to any specific combination of hardware, firmware, and/or software.

In addition to the program 207, the storage device 205 may also be operative to store one or more databases 110' (only one shown). The databases 110' are described in detail below and example structures are depicted with sample entries in the accompanying figures. As will be understood by those skilled in the art, the schematic illustrations and accompanying descriptions of the sample databases presented herein are exemplary arrangements for stored representations of information. Any number of other arrangements may be employed. For example, even though a single database is illustrated, the invention could be practiced effectively using more than one database. Similarly, the illustrated entries of the databases 110' represent exemplary information only; those skilled in the art will understand that the number and content of the entries can be different from those illustrated herein. Further, despite the depiction of the databases 110' as tables, an object based model could be used to store and manipulate the data types of the present invention and likewise, object methods or behaviors can be used to implement the processes of the present invention. These processes are described below in detail with respect to FIGS. 4 through 6.

Figure 3A:
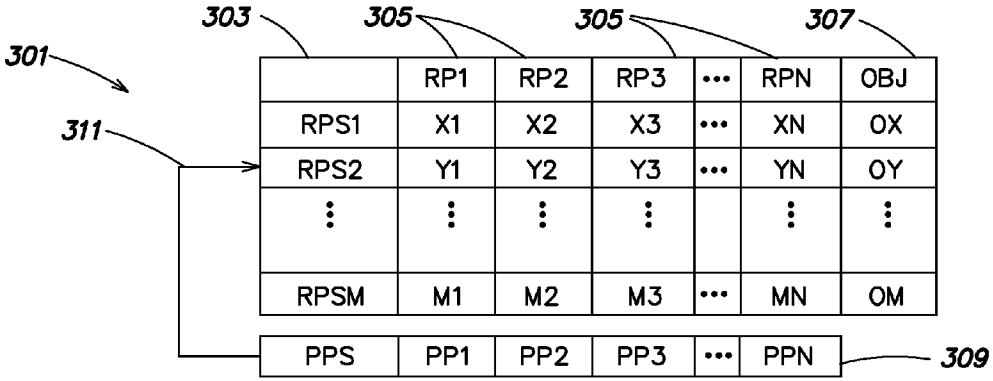
FIGS. 3A-3C depicts an exemplary database that may be included in the interface in accordance with the present invention.
Figure 3B:
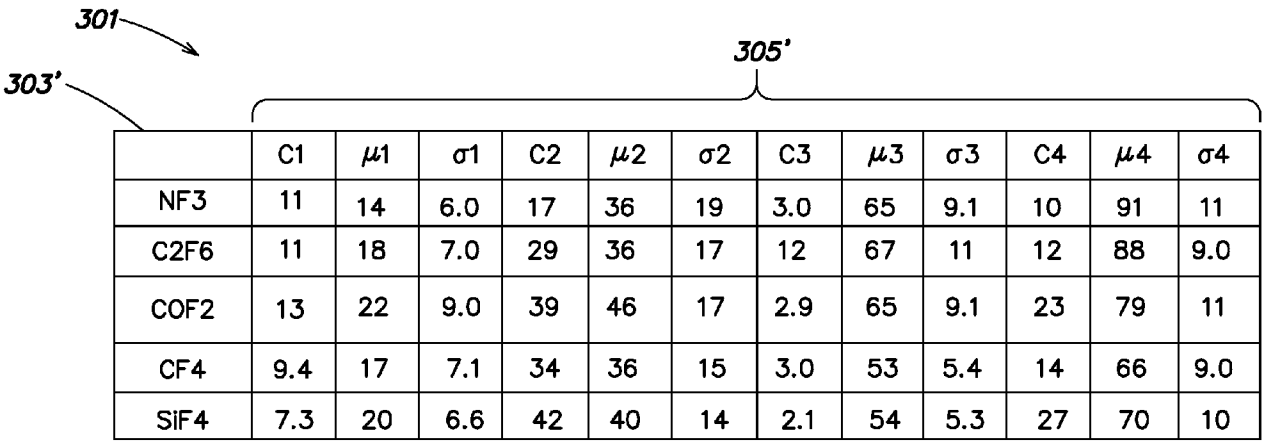
Figure 3C:
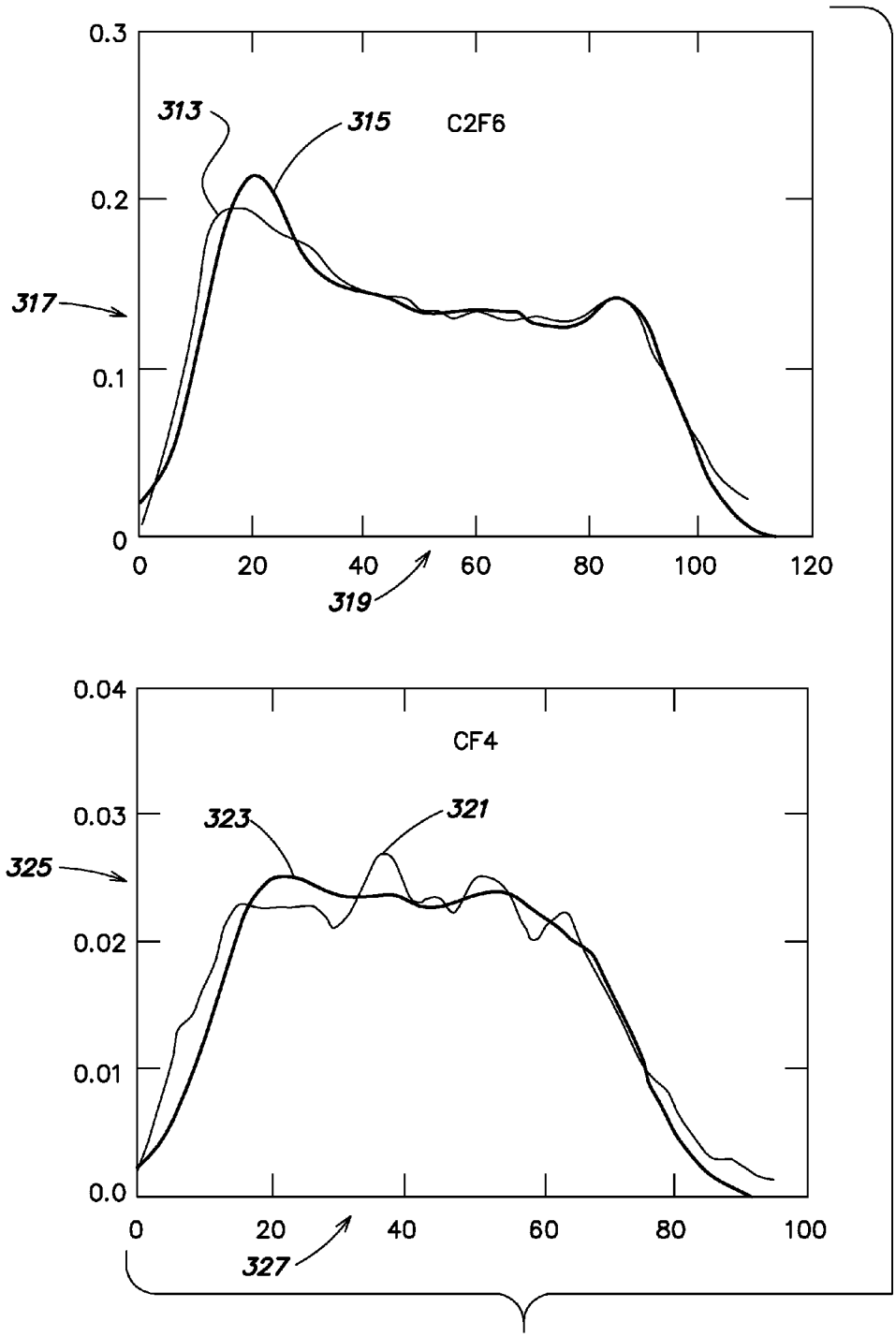

FIGS. 3A-3C depict an exemplary database that may be included in the interface in accordance with the present invention. With reference to FIG. 3A, the database 301 may have a reference parameter sets (RPS) 303 having reference parameters (RP1, RP2, etc.) 305. The database may also have objects (OBJ) 307. The interface 105 may provide a production parameter set (PPS) 309 to the database 301.

The database 301 may contain reference parameters sets 303 having reference parameters 305. The reference parameters 305 may be related to the information provided by the reference system 107. More specifically, the reference parameters 305 may include parameters such as RF power, throttle valve position, chemical makeup of effluents, system type, pump types, abatement unit type, etc. The reference parameter sets 303 may also be derivatives of the information such as averages of values over time, calculated constants, reference system history list, etc. For example, the reference parameter set 305 may have constants of a function. The function may be a curve fit including four normal distributions. The constants may be multipliers of the normal distributions that comprise the function. Such a function is described in more detail below with reference to FIG. 3B.

The database 301 may also contain objects 307. Objects 307 may include items that are not necessarily information provided by/generated from measurement of the reference system 107. For example, the objects 307 may include methods, classes (e.g., C++, assembly, etc.), conditional instructions, data processing routines, etc. In some embodiments, the objects 307 may be correlated with one or more parameter sets 303 and/or parameters 305. In addition or alternatively, the reference parameter sets 303 may be correlated with one or more objects 307.

The database 301 may be a SQL database or other suitable repository of information. In addition or alternatively, one or more extensible Markup Language (XML) documents may be employed to serve as the database 301 or a portion thereof. The information contained by the database 301 may be in binary or another suitable format. For example, in addition or alternatively to the binary format, American Standard Code for Information Interchange (ASCII) coding may be employed to represent the information housed by the database 301. The information may be processed and formatted by the database and/or interface 105. For example, the database 301 may format the information as comma separated values (CSV). In addition or alternatively, the information may be formatted with tags, such as defined by the HyperText Markup Language (HTML) standard, that identify portions of the information in a manner that may be interpreted by the interface 105 to format the information in a pertinent manner. Many other formats may be employed.

The database 301 may be adapted to interact with portions of the interface 105, such as the program 207, so as to provide information and/or objects to the program 207. The interaction with portions of the interface 105 may include providing a production parameter set 309 to the database 301. The production parameter set 309 may be employed by the interface 105 and/or database 301 to query the database 301 so as to select an appropriate reference parameter set 303. An exemplary query is illustrated by an arrow line 311 in FIG. 3A pointing to a potentially relevant record. A selected one or more reference parameter sets 303 may be returned by the database 301 to portions of the interface 105 such as the program 207. Additionally or alternatively, the database 301 may return one or more of the objects 307 or any other suitable objects to the interface 105.

Although the object 307 is depicted as being a part of the database 301, the object 307 or portions of the object 307 may be communicated to the interface 105 by alternative means. For example, the objects 307 may be coupled to the database 301 via a hyperlink to a location on the storage device 205 and thereby provided to the interface 105 via the communication ports 203 (FIG. 2). In addition or alternatively, the object 307 or portions thereof may be provided as an assembly level program included in the production system 103. In other embodiments, the database 301 may be configured to only contain information that has already been processed into reference parameter sets 303 to be employed by the object 307 that is already included in the production system 103. For example, constants, to be employed by the objects 307, generated by analysis of the information provided by the reference system 107 may serve as the reference parameters 305.

Turning to FIG. 3B, an example database populated with exemplary reference parameters is depicted in accordance with the present invention. The database 301 may be populated with reference parameters 305' derived from instruments 108 that measure process gases and/or the effluent within the reference system 107. More specifically, the database 301 may be populated with reference parameters 305' derived from measurements taken during operation of the reference system 107 in which one or more processes may be performed that employ a number of process gases and that generate effluent gases therefrom which may require abatement. The database 301 may be organized into sets of parameters 305' associated with a particular process gas within a process gas set 303'. For example, each row in the database may include parameters 305' that pertain to a particular process gas. As shown in FIG. 3B, a first row of database 301 may include parameters 305' that pertain to process gas $NF_3$, a second row includes parameters 305' that pertain to process gas $C_2F_6$ and so on.

Still referring to FIG. 3B, the process gas set 303' may include reference parameters 305' that are factors derived from the information provided by the instruments 108. The reference parameters 305' may be factors employed by an object 307 such as a function of normal distributions. Such a function may be the exemplary equation $$S(t) = \sum_{n=1}^{4} C_n \cdot N(t, \mu_n, \sigma_n).$$

Where the variables $C_n$, $\mu_n$, $\sigma_n$, t, n, and N represent the reference parameters stored in the database 301. The function may be stored on the data storage device 205 and employed by the processor 201. In addition, or alternatively, the function may be communicated to the interface 105 via the communication ports 203. The reference parameters 305' may be employed by the interface 105 in addition to the exemplary equation so as to predict parameters of the production system 103. For example, the reference parameters 305' may be employed to predict the presence or concentration of gases in the effluents with respect to time. Such a function may produce a plot, when evaluated that serves as a visual depiction of the function.

Turning to FIG. 3C, plots depicting an exemplary prediction of the quantity of gases with respect to time in accordance with the present invention. The exemplary plots depict the concentration of the gases C2F6 and CF4 in the effluent from the process. The plots may include a C2F6 gas data curve 313 and a C2F6 gas function curve 315. The plot also depicts the C2F6 gas concentration scale 317 and C2F6 gas time scale 319. The plots may also include a CF4 gas data curve 321 and a CF4 gas function curve 323. The CF4 gas concentration scale 325 and CF4 gas time scale 327 may also be depicted in the plots.

The information comprising the C2F6 gas data curve 313 and CF4 gas data curve 321 (data curves) may be provided by the instruments 108 to a workstation or other suitable information analysis apparatus. The workstation may analyze the information so as to form the function. In addition or alternatively, the instruments 108 may analyze the information. For example, the instruments 108 may analyze the information and provide the reference parameters 305'. The analysis of the information may be to fit the curve of the equation to the data curves. For example, the C2F6 gas function curve 315 and the CF4 gas function curve 323 (function curves) may be fitted to each data curve.

Each function curve may correspond to a reference parameter set 303'. For example, the C2F6 gas function curve 315 may correspond with a C2F6 gas reference parameter set 303' depicted in FIG. 3B. The C2F6 gas function curve 315 may be produced by the equation employing the C2F6 gas reference parameter set 303'. The equation employing the reference parameter set 303' may be employed by the interface 105 to predict parameters of the production system 103. For example, the equation may predict the concentration of C2F6 gas in the effluent produced by the production system 103. As discussed above, the reference parameters 305' may be provided to the interface. In addition, objects, such as equations, corresponding to the reference parameter sets 303' may also be provided to the interface 105.

As discussed above with reference to FIG. 3A, the interface 105 may employ the reference parameter sets 303 and/or the object 307 returned to the interface to predict at least one system parameter of the production electronic device manufacturing system 103, as will be described below with reference to FIGS. 4-7.

Figure 4:
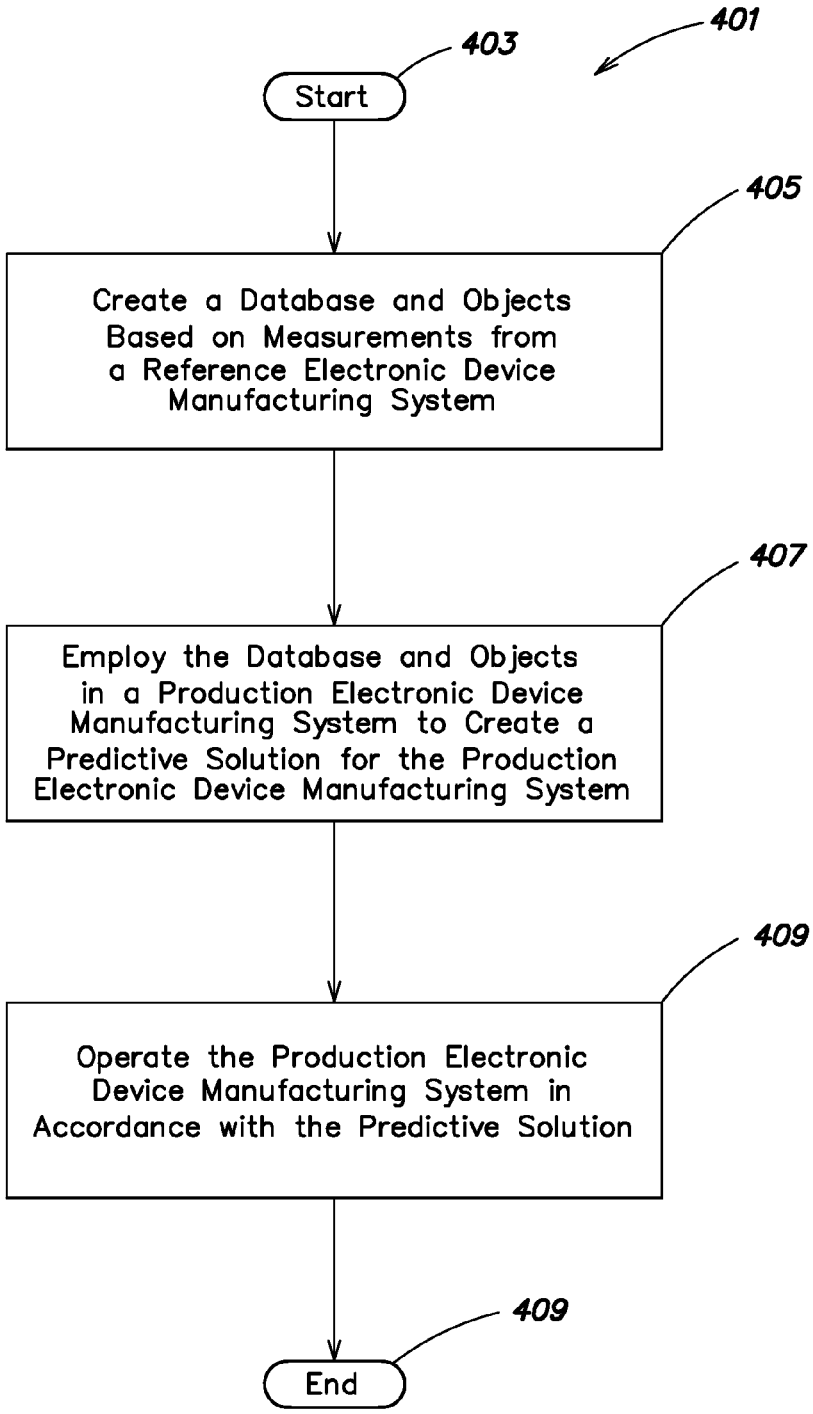
FIG. 4 is an exemplary method of electronic device manufacturing in accordance with the present invention.

The operation of the system 101 for improving electronic device manufacturing is now described with reference to FIGS. 1-3 and with reference to FIG. 4 which is a flow chart that illustrates an exemplary method of electronic device manufacturing in accordance with the present invention. With reference to FIG. 4, in step 403, the method 401 begins. In step 405, a database and/or objects are created based on measurements from a reference electronic device manufacturing system 107. As described above, the instruments 108 and/or devices included with and/or coupled to the reference system 107 may collect information (e.g., status, operational data, etc.) related to the reference system 107. The reference system 107 may store the collected data in one or more databases 110. In this manner, over time, the components of the reference system 107 may provide information. In particular, the information may include information related to the parameters of the reference system 107. The information may be employed by an agent (e.g., engineer, operator program, etc.) to determine how to appropriately control portions of the reference system 107 or a production system 103 similar to the reference system 107. For example, the information may be employed by the agent to more optimally control components downstream from a production electronic device manufacturing tool 113. The downstream components may include pump units 119, abatement units 121, etc. Consequently, the reference system 107 may provide information that may be employed to develop and/or implement objects (e.g., rules, programs, operational guidelines, etc.) for optimizing operation of the production system 103.

In step 407, the database 110' and/or objects 307 are employed by a production electronic device manufacturing system 103 to more optimally operate the production electronic device manufacturing system 103. The database 110' and/or objects 307 may include information about how to control components of the production system 103 in response to limited performance and/or limited feedback information provided during electronic device manufacturing. More specifically, the production system 103 employs the database 110' and program 207, which were created using the reference system 107 via the database 110', to create a predictive solution for the production system 103 based on limited information provided by the production system 103. In this manner, the production system 103 benefits from the information (e.g., system operation parameters) collected by the reference system 107 without the cost burden of the instruments 108 (FIG. 1). Details of how the database 110' and program 207 are employed by the production system 103 to create a predictive solution are described below with reference to FIGS. 5 and 6, each of which describe an exemplary method of creating a predictive solution for an electronic device manufacturing system.

In step 409, the production electronic device manufacturing system operates in accordance with the predictive solution. For example, the interface 105 may control operation of components of the production system 103, such as the processing chamber 115, abatement unit 121, etc., in accordance with the predictive solution. The interface 105 may communicate with a control system (not shown) of the production system 103 to operate the production system 103.

Thereafter, in step 411, the method 401 ends. Through use of the method 401 of FIG. 4, communication among components of a production system 103 and information obtained from a reference system 107 may be employed to improve operation of the production system 103 (e.g., to improve the combined operation of all components of the production system 103). The method 401 may also reduce downtime for maintenance and repair, enable prediction of when a preventive maintenance may need to be performed and/or provide a diagnostic means to monitor the health of the system 103. For example, the method 401 may by used to reduce resource consumption and operational cost of the production system 103. Further, the present method 401 may be used to minimize hazardous emissions resulting from electronic device manufacturing, thereby reducing the negative environmental impact of such manufacturing.

Figure 5:
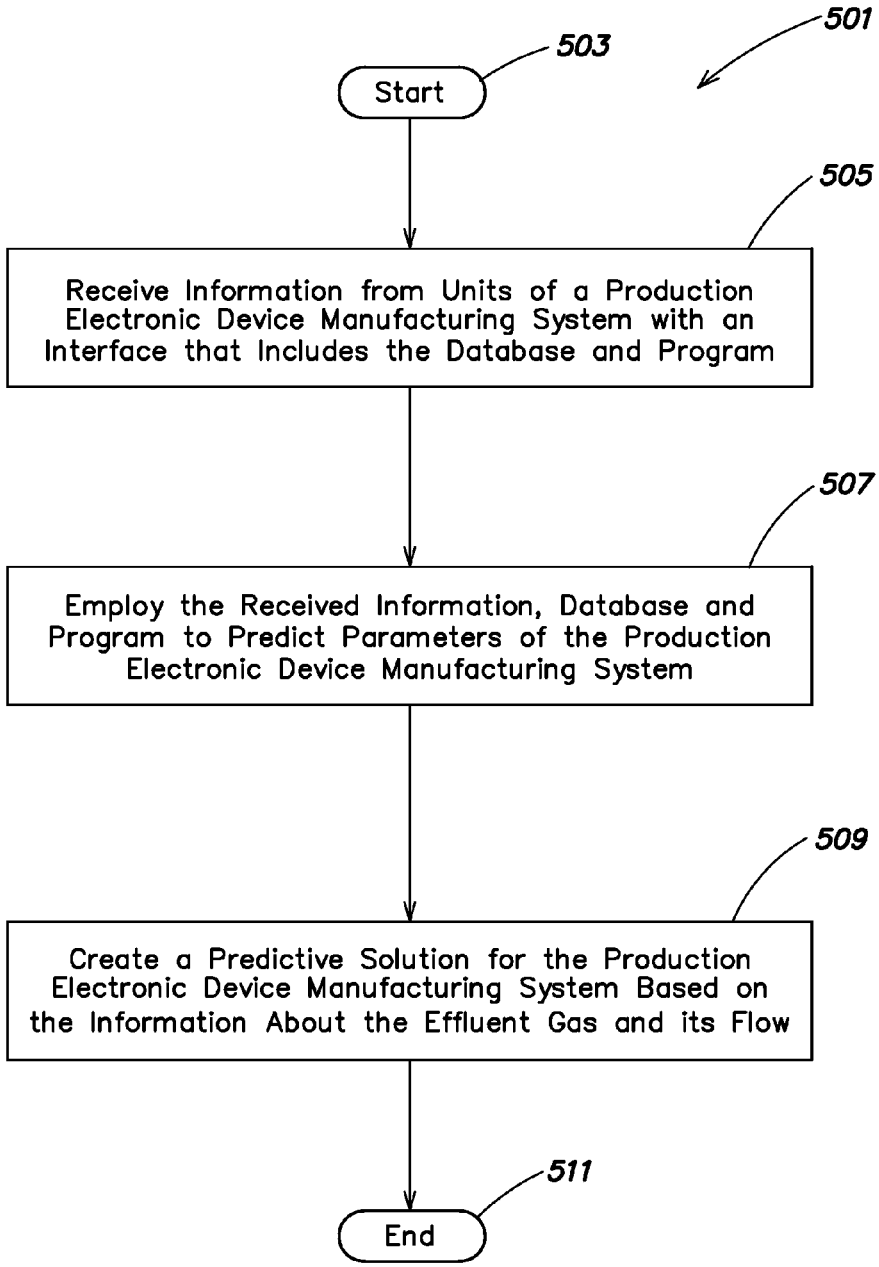
FIG. 5 is a first exemplary method of optimizing the performance of an electronic device manufacturing system in real time in accordance with the present invention.

As described above, during electronic device manufacturing in accordance with the present invention, the interface 105 may create a predictive solution. FIG. 5 is a flow chart depicted a first exemplary method of creating a predictive solution for an electronic device manufacturing system in accordance with the present invention. With reference to FIG. 5, in step 503, the method 501 begins. In step 505, an interface 105 that includes a database 110' and program 207 may receive data (e.g., information) from units in the production system 103 such as the chemical delivery unit 111 and the processing chambers 115 and/or controllers. For example, the interface 105 may receive information, such as the presence of a certain gas at the output of the chemical delivery unit 111 and/or the electronic device manufacturing tool 113, obtained from the sensors 117 and/or controllers 118. The information may include chamber process status information, such as precursor gas type and flow employed by the chamber 115, pressure in the chamber 115, power applied to the chamber 115, status of a wafer processed in the chamber 115, recipe step currently performed by the chamber 115, time elapsed performing the current step, etc. Parameters stored in database 110' may include type of production tool 103, type of processing chambers 115, recipe step, step time, pressure, temperature, gas flow rates, wafer type, and RF power. In some embodiments, the interface 105 may receive such information once per second. However, the information may be provided to the interface more or less frequently. This information may be acquired inexpensively. Note that because the information provided by the sensors 117 and/or controllers 118 may be limited, predictions based solely on such information may not be sufficient to determine optimum performance, and therefore, alone, the production system 103 may operate inefficiently (e.g., may operate components unnecessarily) without use of the present invention.

However, in step 507, the received information, database 110' and program 207 are employed to predict parameters of the electronic device manufacturing system 103. For example, the program 207 may receive the information provided by the sensors 117 and/or controllers 118 and access the database 110' to predict (e.g., accurately) information about effluent flow (e.g., gases and solids) to an exhaust system, such as the abatement unit 121. The interface 105 may predict a type and quantity of processing chamber effluents. The interface 105 may also predict the maintenance requirement of the production system 103 or portions thereof. The maintenance requirement may be due to the effluent flow. For example, by predicting the type and quantity of the effluents, the pump speed of the pump units 119 may be changed in accordance with the type and quantity of the effluents as a function of time. In this manner, the maintenance schedule of the pump units 119 may be predicted. The interface 105 may predict maintenance requirements, or facility problems. The interface 105 may also be employed to detect trends and send warning and/or alarms when a parameter that is being trended falls out of preset lower and higher limits.

In step 509, a predictive solution for the production electronic device manufacturing system 103 may be created based on the information about the effluent gas and its flow. As stated, the predictive solution may include information about how to control components of the production system 103 during electronic device manufacturing. For example, based on the predicted effluent flow to the abatement unit 121, a predictive solution in which the abatement unit 121 is only operated when effluents require treatment may be created. The abatement unit 121 may adapt the amount of chemicals, electricity, water, etc., employed during effluent treatment, accordingly. In this manner, the duty cycle of components, such as the abatement unit 121, may be reduced. Further, use of consumables, such as chemicals employed by the abatement unit 121 to treat effluents, may be reduced. Consequently, the predictive solution for the production system 103 indicates (e.g., instructs) how to control components of the production system 103 such that the production system 103 is operated in an efficient manner.

Thereafter, in step 511, the method 501 of FIG. 5 ends. Through use of the method 501 of FIG. 5, the interface 105 may receive limited information from components of the production system 103, such as a chemical delivery unit 111 and/or a processing chamber 115 and create a predictive solution for the production system 103. More specifically, a program uses the limited information to implement a set of operational rules for creating the predictive solution. In this manner, the interface 105 may determine how to improve operation of the abatement unit 121 (e.g., how to operate the abatement unit 121 in an efficient manner).

Figure 6:
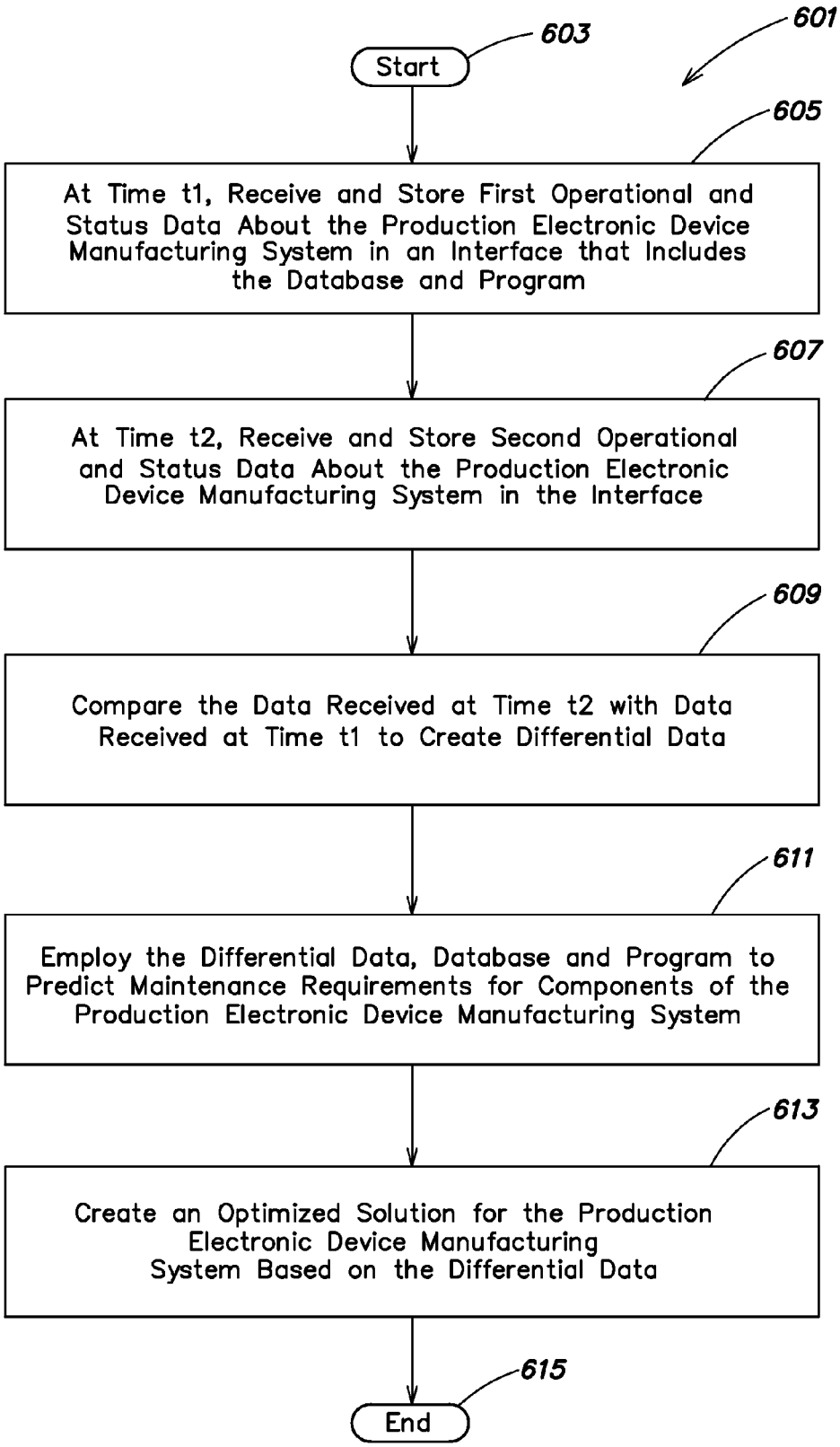
FIG. 6 is a second exemplary method of optimizing the performance of an electronic device manufacturing system in accordance with the present invention.

FIG. 6 is a flow chart depicting a second exemplary method of creating a predictive solution for an electronic device manufacturing system in accordance with the present invention. With reference to FIG. 6, in step 603, the method 601 begins. In step 605, at time t1, first operational and status data about the production electronic device manufacturing system 103 is received and stored in an interface 105 that includes a database 110' and program 207. For example, at time t1, the interface 105 may receive data (e.g., information) about actual flow of a gas (e.g., from a processing chamber 115), type of gas, wafer count, a pressure in the processing chamber 115, a temperature in the processing chamber 115, whether an exhaust system (e.g., pump unit 119 or abatement unit 121) is blocked, contaminant concentration at a processing chamber 115, contaminant concentration at the abatement unit 121 and/or whether a processing chamber endpoint signal is detected, etc. It should be understood that the above list of information that may be received by the interface 105 is merely exemplary. The interface 105 may receive more and/or different information.

In step 607, at time t2, the interface 105 may receive and store second operational and status data about the production system 103. More specifically, at time t2, the interface 105 may receive some or all of the information listed above with respect to step 605.

In step 609, the data received at time t2 may be compared with the data received at time t1 to create differential data. For example, the interface 105 may compare a pressure in the processing chamber at time t1 with a pressure in the processing chamber at time t2 and determine that the pressure in the processing chamber increased or decreased by a certain amount from time t1 to time t2. In this manner, the differential data may indicate changes to the production system 103 from time t1 to time t2.

In step 611, the differential data, database and program are employed to predict maintenance requirements for components of the production system 103. For example, the database 110' may include differential data collected during operation of the reference system 107. Further, the program 207 may be adapted to receive differential data created by the interface 105, access the database 110' and predict maintenance requirements for components of the production system 103. In this manner, the interface 105 predicts when a component of the production system 103 requires maintenance based on data (e.g., real-time data) provided by the production system 103 during electronic device manufacturing. In contrast, conventional maintenance calculations are based on assumptions that are typically conservative or worst case and therefore, parts of conventional electronic device manufacturing systems may be unnecessarily serviced. Consequently, the interface 105 provides a more accurate determination of the maintenance requirements of the production system 103, which may reduce maintenance cost and reduce overall system downtime.

In step 613, a predictive solution is created for the production system 103 based on the differential data. More specifically, the interface employs the differential data (along with the database 110' and program 207) to predict maintenance requirements of components of the production system 103. Based on such predictions, the interface 105 may create a solution that instructs how to operate components of the production system 103. The interface 105 may control operation of components of the production system 103 in accordance with the predictive solution. The interface 105 may communicate with a control system (not shown) of the production system 103 to operate the production system 103 in accordance with the predictive solution.

Thereafter, in step 615, the method 601 of FIG. 6 ends. Through use of the method 601 of FIG. 6, the interface 105 may reduce maintenance costs and increase system availability by predicting required maintenance for components of the production system 103. In this manner, the method 601 creates a more predictive solution for the production system 103.

Figure 7:
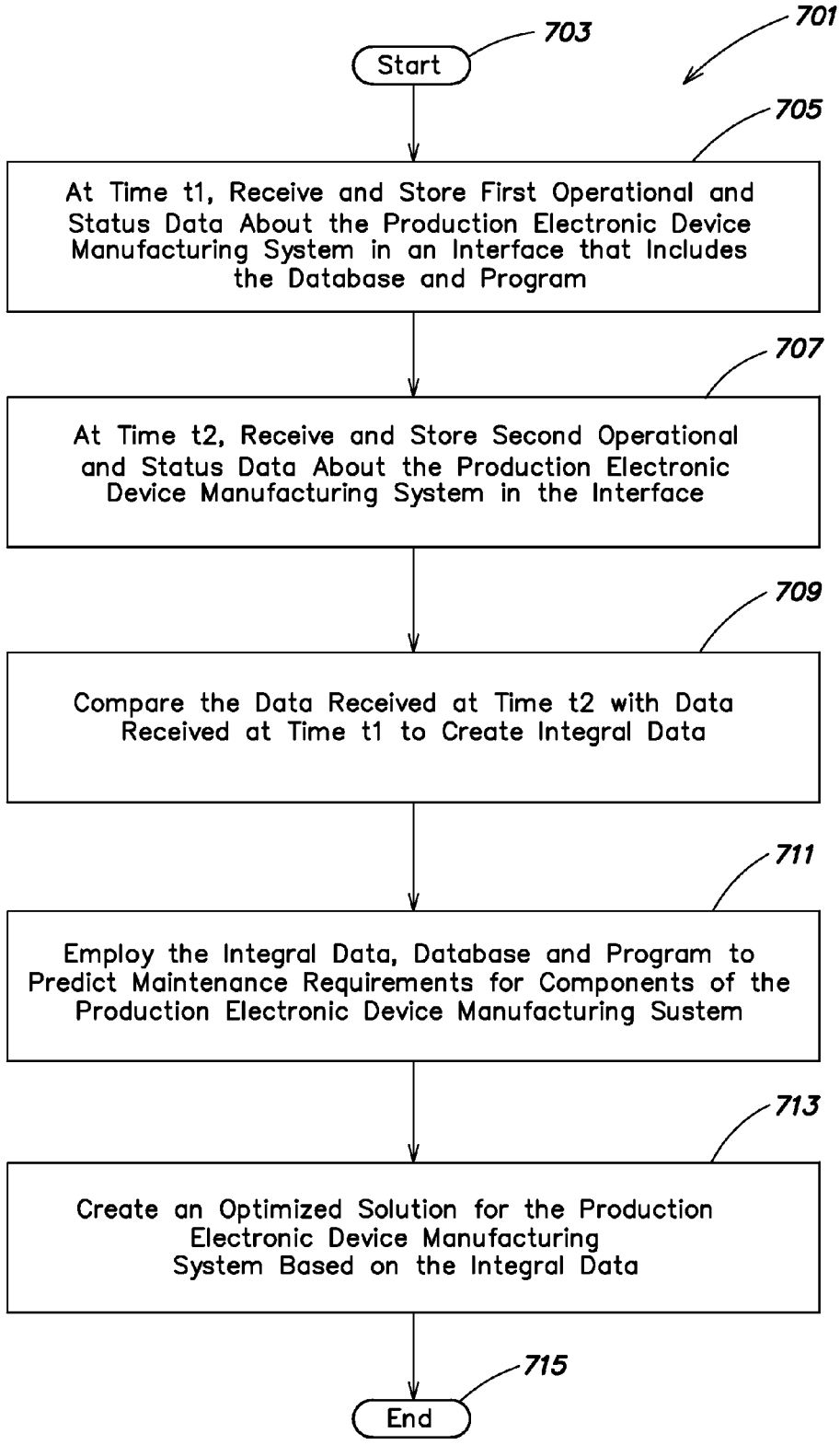
FIG. 7 is a third exemplary method of optimizing the performance of an electronic device manufacturing system in accordance with the present invention.

FIG. 7 is a flow chart depicting another exemplary method of creating a predictive solution for an electronic device manufacturing system in accordance with the present invention. With reference to FIG. 7, in step 703, the method 701 begins. In step 705, at time t1, first operational and status data about the production electronic device manufacturing system 103 is received and stored in an interface 105 that includes a database 110' and program 207. For example, at time t1, the interface 105 may receive data (e.g., information) about actual flow of a gas (e.g., from a processing chamber 115), type of gas, wafer count, a pressure in the processing chamber 115, a temperature in the processing chamber 115, whether an exhaust system (e.g., pump unit 119 or abatement unit 121) is blocked, contaminant concentration at a processing chamber 115, contaminant concentration at the abatement unit 121 and/or whether a processing chamber endpoint signal is detected, etc. It should be understood that the previous list of information that may be received by the interface 105 is exemplary. The interface 105 may receive more and/or different information.

In step 707, at time t2, the interface 105 may receive and store second operational and status data about the production system 103. More specifically, at time t2, the interface 105 may receive some or all of the information listed above while describing step 705.

In step 709, the data received at time t2 may be compared with the data received at time t1 to create integral data. For example, the interface 105 may compare a chemical flow rate in the processing chamber at time t1 with the chemical flow rate in the processing chamber at time t2 and determine that the total amount of chemistry flowed through the chamber between time t1 and t2. In this manner, the integral data may indicate changes to the production system 103 from time t1 to time t2.

In step 711, the integral data, database and program are employed to predict maintenance requirements for components of the production system 103. For example, the database 110' may include integral data collected during operation of the reference system 107. Further, the program 207 may be adapted to receive integral data created by the interface 105, access the database 110' and predict maintenance requirements for components of the production system 103. In this manner, the interface 105 predicts when a component of the production system 103 requires maintenance based on data (e.g., real-time data) provided by the production system 103 during electronic device manufacturing. In contrast, conventional maintenance calculations are based on assumptions that are typically conservative or worst case and therefore, parts of conventional electronic device manufacturing systems may be unnecessarily serviced. Consequently, the interface 105 provides a more accurate determination of the maintenance requirements of the production system 103, which may reduce maintenance cost and reduce overall system downtime.

In step 713, a predictive solution is created for the production system 103 based on the integral data. More specifically, the interface employs the integral data (along with the database 110' and program 207) to predict maintenance requirements of components of the production system 103. Based on such predictions, the interface 105 may create a solution that instructs how to operate components of the production system 103. The interface 105 may control operation of components of the production system 103 in accordance with the predictive solution. The interface 105 may communicate with a control system (not shown) of the production system 103 to operate the production system 103 in accordance with the predictive solution.

Thereafter, in step 715, the method 701 of FIG. 7 ends. Through use of the method 701 of FIG. 7, the interface 105 may reduce maintenance costs and increase system availability by predicting required maintenance for components of the production system 103. In this manner, the method 701 creates a more predictive solution for the production system 103.

The optimal operation methods (e.g., predictive solutions) may be sold to customers. For example, access to the database and programs may be provided to the customer via the Internet for a subscription fee. Additionally or alternatively, the database and programs may be provided as part of a software upgrade that is installed on the production system 103 by a customer or customer support personnel.

The foregoing description discloses only exemplary embodiments of the invention. Modifications of the above disclosed apparatus and method which fall within the scope of the invention will be readily apparent to those of ordinary skill in the art. For instance, the methods and apparatus described above may be applied to systems with multiple different configurations including, but not limited to, a single abatement system coupled to multiple process chambers, multiple pumps coupled to a single process chamber, etc.

Accordingly, while the present invention has been disclosed in connection with exemplary embodiments thereof, it should be understood that other embodiments may fall within the spirit and scope of the invention, as defined by the following claims.

The invention claimed is:

1. A method for operating an electronic device manufacturing system for use with one or more abatement units, comprising:

providing a reference electronic device manufacturing system having a first measurement instrument and a production electronic device manufacturing system having a second measurement instrument, wherein the first measurement instrument is different than the second measurement instrument;

selecting reference information, where the reference information is based on measurements of the reference electronic device manufacturing system taken with the first measurement instrument, and wherein selecting the reference information is done based on production information obtained from measuring the production electronic device manufacturing system;

determining an operational control setting for one or more components of a production electronic device manufacturing system, based on the reference information; and operating an abatement unit of the production electronic device manufacturing system based on the operational control setting, wherein the reference electronic device manufacturing system includes at least one instrument not used in the production electronic device manufacturing system.

2. The method for operating an electronic device manufacturing system of claim 1, wherein the step of obtaining production information further comprises the step of differentially comparing first production information at time $t_1$, with second production information at time $t_2$.

3. The method for operating an electronic device manufacturing system of claim 1, wherein the step of obtaining production information further comprises the step of integrally comparing first production information at time $t_1$, with second production information at time $t_2$.

4. The method for operating an electronic device manufacturing system of claim 1, wherein the component is a pump.

5. The method for operating an electronic device manufacturing system of claim 1, wherein the at least one instrument is a Fourier transform infrared spectrometer.

6. The method for operating an electronic device manufacturing system of claim 1, wherein the at least one instrument is a quadrupole mass spectrometer.

7. The method for operating an electronic device manufacturing system of claim 1, wherein the operational control setting is to operate the abatement unit only when the effluent requires treatment, and thereby reduce a duty cycle of the abatement unit.

8. The method for operating an electronic device manufacturing system of claim 1, wherein the operational control setting is to operate the abatement unit only when the effluent requires treatment and thereby reduce a resource consumption of the production electronic device manufacturing system.

9. A method for operating an electronic device manufacturing system for use with one or more abatement units, comprising:

providing a reference electronic device manufacturing system having a first measurement instrument and a production electronic device manufacturing system having a second measurement instrument, wherein the first measurement instrument is different than the second measurement instrument;

selecting reference information, where the reference information is based on measurements of the reference electronic device manufacturing system taken with the first measurement device, and wherein selecting the reference information is done based on production information obtained from measuring the production electronic device manufacturing system; and determining when an abatement unit of a production electronic device manufacturing system requires maintenance, based on a predictive value of the reference information, wherein the reference electronic device manufacturing system includes at least one instrument not used in the production electronic device manufacturing system.

10. The method for operating an electronic device manufacturing system of claim 9, wherein the step of obtaining production information further comprises the step of differentially comparing first production information at time $t_1$, with second production information at time $t_2$.

11. The method for operating an electronic device manufacturing system of claim 9, wherein the step of obtaining production information further comprises the step of integrally comparing first production information at time $t_1$, with second production information at time $t_2$.

12. The method for operating an electronic device manufacturing system of claim 9, wherein the at least one instrument is a Fourier transform infrared spectrometer.

13. The method for operating an electronic device manufacturing system of claim 9, wherein the at least one instrument is a quadrupole mass spectrometer.

14. A method for operating an electronic device manufacturing system for use with one or more abatement units, comprising:

providing a reference electronic device manufacturing system having a first measurement instrument and a production electronic device manufacturing system having a second measurement instrument, wherein the first measurement instrument is different than the second measurement instrument;

selecting reference information, where the reference information is based on measurements of the reference electronic device manufacturing system taken with the first measurement device, and wherein selecting the reference information is done based on production information obtained from measuring the production electronic device manufacturing system;

predicting at least one future value of a production parameter;

determining an operational control setting for a component of a production electronic device manufacturing system, based on the at least one predicted future value; and operating an abatement unit of the production electronic device manufacturing system based on the operational control setting, wherein the reference electronic device manufacturing system includes at least one instrument not used in the production electronic device manufacturing system.

15. The method for operating an electronic device manufacturing system of claim 14, wherein the at least one instrument is a Fourier transform infrared spectrometer.

16. The method for operating an electronic device manufacturing system of claim 14, wherein the at least one instrument is a quadrupole mass spectrometer.

* * * * *